US009639038B1

(12) United States Patent
Cao et al.

(10) Patent No.: US 9,639,038 B1
(45) Date of Patent: May 2, 2017

(54) POWER MANAGEMENT AND CONTROL FOR A FUSER OF AN ELECTROPHOTOGRAPHIC IMAGING DEVICE

(71) Applicant: Lexmark International, Inc., Lexington, KY (US)

(72) Inventors: Jichang Cao, Lexington, KY (US); Christopher E. Rhoads, Georgetown, KY (US); John P. Richey, Lexington, KY (US); David Anthony Schneider, Lexington, KY (US); Daniel Steinberg, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 14/985,809

(22) Filed: Dec. 31, 2015

(51) Int. Cl.
*G03G 15/20* (2006.01)

(52) U.S. Cl.
CPC ..... *G03G 15/2039* (2013.01)

(58) Field of Classification Search
CPC ..... G03G 15/5004; G03G 15/205
USPC ..... 399/70
See application file for complete search history.

(56) References Cited

U.S. PATENT DOCUMENTS 5,656,187 A * 8/1997 Miyamoto ..... G03G 15/2003 219/216
8,948,628 B2 * 2/2015 Okunishi ..... G03G 15/5004 399/37
2010/0209131 A1 * 8/2010 Kagawa ..... G03G 15/5004 399/70

* cited by examiner

*Primary Examiner* — Billy Lactaoen
*Assistant Examiner* — Arlene Heredia Ocasio

(57) ABSTRACT

A system and method for controlling the fuser assembly of an electrophotographic imaging device, including initiating reading line current and line voltage for a plurality of consecutive AC cycles; from the AC cycle readings, identifying heater on cycles in which power is applied to the fuser heater and heater off cycles in which power is not applied to the fuser heater; calculating heater power from the identified heater on cycles and the heater off cycles, the heater power being the power of the fuser heater during a predetermined heater on cycle of the consecutive AC cycles; calculating a fuser heater voltage of the fuser heater during the predetermined heater on cycle based on the voltage readings; calculating a resistance of the fuser heater based on the calculated heater power and the calculated fuser heater voltage; and controlling the fuser assembly based upon the calculated resistance of the fuser heater.

20 Claims, 13 Drawing Sheets

POWER MANAGEMENT AND CONTROL FOR A FUSER OF AN ELECTROPHOTOGRAPHIC IMAGING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to fuser control in an electrophotographic imaging device, and particularly to an apparatus and methods for more effectively and efficiently controlling the fuser assembly of an imaging device.

2. Description of the Related Art

Alternating current (AC) line voltage and power quality across the world are not always within listed specifications and often vary considerably. This can be due to problems and shortcomings with the power grid or even with the power distribution inside a building. The voltage or power quality variation has a substantial impact on the operation of electrophotographic printing devices, and particularly on fuser temperature control and printer performance because fuser heater power changes dramatically with AC line voltage variation. Fuser heater power variations have been seen to cause a number of problems. For instance, excessive fuser heater power increases the likelihood of cracking of the fuser heater in the belt fuser. Low fuser heater power often leads to insufficient fusing of toner to sheets of media because the fuser heater cannot maintain suitable fusing temperature for acceptable toner fusing. When fusing temperatures cannot be maintained during a printing operation, the printer may stop printing altogether and issue an error, often leading to a disruption in work by those needing timely printed material. Significant fuser heater power variation also makes it difficult to predict the amount of time needed for a fuser to be ready for performing fusing during a print operation. Inaccurate prediction of such "fuser ready time" may cause poor toner fusing because media sheets enter into the fuser nip of the fuser assembly too early or arrive too late, oftentimes leading to the imaging device flagging an error and stopping the print job before completion. Further, sizeable power variations make it difficult to achieve relatively tight temperature control of the fuser heater. Sizeable variation in fuser heater temperature during a print operation has been seen to cause hot offset in which toner is undesirably transferred to the belt of the fusing assembly when fusing temperatures are too high, resulting in the transferred toner transferring back to the media sheet one belt revolution later. Further, toner that is fused at elevated temperatures oftentimes does not have a shiny appearance.

Still further, fusing toner at elevated temperatures can result in media sheets undesirably wrapping around the belt of the fuser assembly instead of exiting therefrom, thereby leading to a media jam condition and a further disruption in printing.

To address the above challenges, some existing imaging devices use the time it takes for a fuser heater to be warmed to fusing temperatures to predict the AC line voltage. However, such predictions are often inaccurate due to the fuser heater warm up time being influenced by other factors such as variation of initial fuser heater temperature prior to fuser heater warm up, fuser heater resistance distribution, variation in fuser heater thickness, the operation of the thermistor which is secured to the fuser heater, and the contact between the thermistor and fuser heater.

Further, existing algorithms for checking excessive fuser heater power are often executed only when the fuser heater temperature is very low, such as less than 50 degrees C. during power up of the imaging device or when the imaging device wakes up and/or exits from a sleep mode of operation.

SUMMARY

Example embodiments are directed to methods of managing the power and of controlling the fuser assembly of an electrophotographic imaging device to overcome or at least mitigate the problems and shortcomings described above. A method, according to an example embodiment, includes initiating a preheat operation for preheating a fuser heater of the fuser assembly; and when the fuser heater temperature reaches a predetermined temperature during the preheat operation, reading, by the electrophotographic device, current and voltage of the electrophotographic device for a plurality of consecutive AC cycles. From the current and voltage readings, the electrophotographic device determines, from the plurality of consecutive AC cycles, heater on cycles in which power is applied to the fuser heater and heater off cycles in which power is not applied to the fuser heater, and calculates heater power from the current and voltage readings and the determinations of the heater on cycles and the heater off cycles, with the heater power being the power of the fuser heater during a predetermined heater on cycle of the consecutive AC cycles. The electrophotographic device calculates a fuser heater voltage of the fuser heater during the predetermined heater on cycle based on the voltage readings, and calculates a resistance of the fuser heater based on the calculated heater power and the calculated fuser heater voltage. The electrophotographic device controls the fuser assembly based upon the calculated resistance of the fuser heater.

The example method may further include identifying a first heater off cycle of the consecutive AC cycles and calculating heater power based upon a first factor multiplied by a difference between a power level of the imaging device in a first heater on cycle immediately prior to the first heater off cycle and the power level of the imaging device in the first heater off cycle. The method may further calculate the fuser heater voltage based upon the voltage reading of the electrophotographic device in the first heater on cycle and the voltage reading of the imaging device in the first heater off cycle.

In another example embodiment, there is disclosed an imaging device including a photoconductive member; a developer unit for developing a toner image on the photoconductive member; at least one toner transfer area for transferring the toner image to a sheet of media as the sheet of media passes through the toner transfer area in a media feed direction; and a fuser assembly positioned downstream of the at least one toner transfer area in the media feed direction for fusing toner transferred to the sheet of media, the fuser assembly including a fuser heater member. The example imaging device further includes a power supply circuit coupled to the fuser assembly for supply power thereto; and a controller coupled to the power supply circuit and the fuser assembly for controlling heat generated by the fuser heater member, and memory coupled to the controller.

The controller is configured to execute instructions stored in the memory for, when a temperature of the fuser heater member reaches a predetermined temperature during a preheat operation, receiving current and voltage readings of the imaging device for a plurality of consecutive AC cycles; from the current and voltage readings, determining, from the plurality of consecutive AC cycles, heater on cycles in which power is applied to the fuser heater member and heater off cycles in which power is not applied to the fuser heater member; calculating heater power from the current and voltage readings and the determinations of the heater on cycles and the heater off cycles, the heater power being the power of the fuser heater member during a predetermined heater on cycle of the consecutive AC cycles; calculating a fuser heater voltage of the fuser heater member during the predetermined heater on cycle based on the calculated voltage readings; and calculating a resistance of the fuser heater member based on the calculated heater power and the calculated fuser heater voltage. The controller then operates the fuser assembly based upon the calculated resistance of the fuser heater member.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
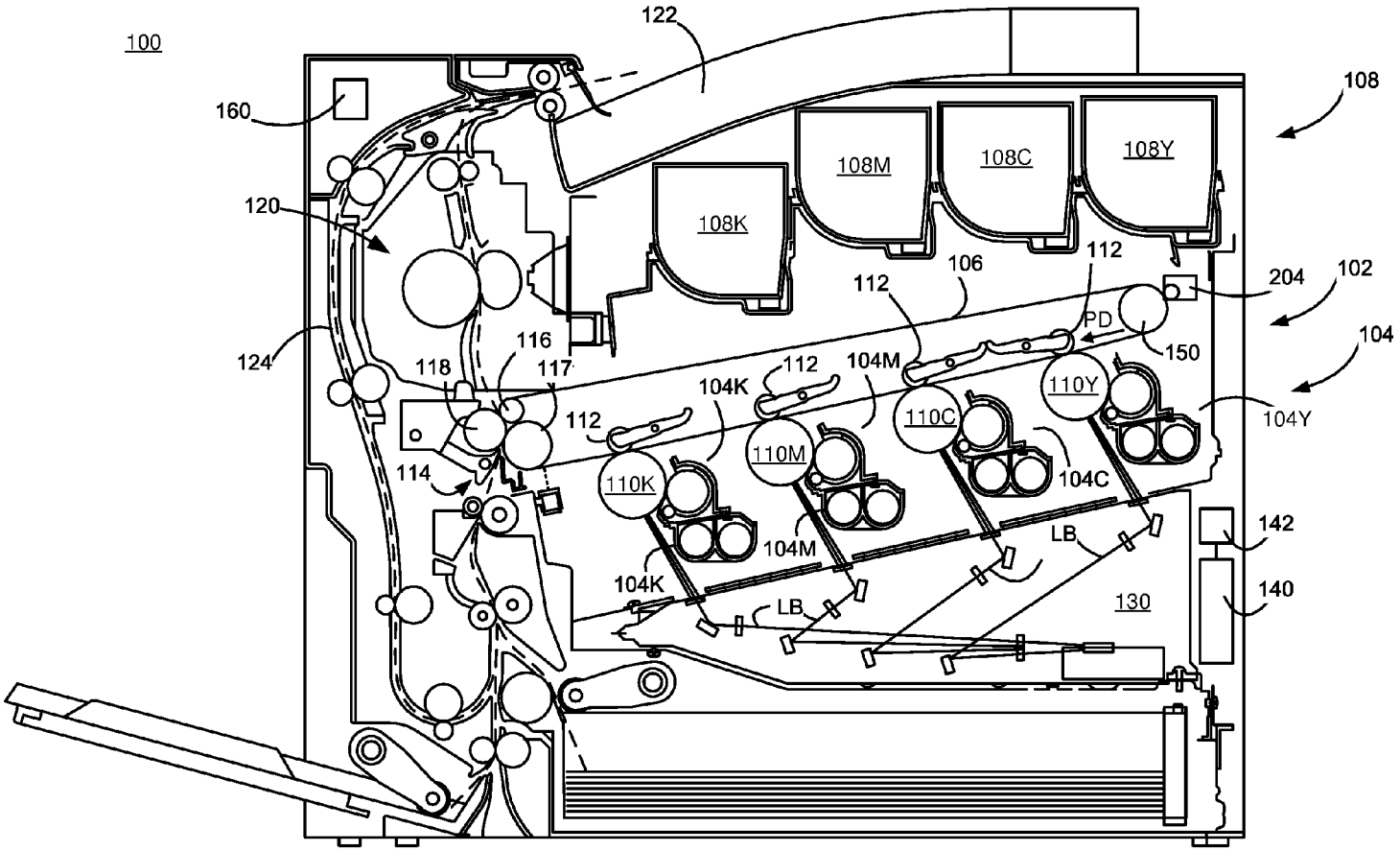
FIG. 1 is a side elevational view of an imaging device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first toner transfer area 102 having four developer units 104Y, 104C, 104M and 104K that substantially extend from one end of imaging device 100 to an opposed end thereof. Developer units 104 are disposed along an intermediate transfer member (ITM) 106. Each developer unit 104 holds a different color toner. The developer units 104 may be aligned in order relative to a process direction PD of the ITM belt 106, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in a printing operation. Each toner reservoir 108Y, 108C, 108M and 108K is controlled to supply toner as needed to its corresponding developer unit 104. Each developer unit 104 is associated with a photoconductive member 110Y, 110C, 110M and 110K that receives toner therefrom during toner development in order to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM belt 106 is disposed adjacent to each of developer unit 104. In this embodiment, ITM belt 106 is formed as an endless belt disposed about a backup roll 116, a drive roll 117 and a tension roll 150. During image forming or imaging operations, ITM belt 106 moves past photoconductive members 110 in process direction PD as viewed in FIG. 1. One or more of photoconductive members 110 applies its toner image in its respective color to ITM belt 106. For monocolor images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM belt 106.

ITM belt 106 rotates and collects the one or more toner images from the one or more developer units 104 and then conveys the one or more toner images to a media sheet at a second transfer area 114. Second transfer area 114 includes a second transfer nip formed between back-up roll 116, drive roll 117 and a second transfer roller 118. Tension roll 150 is disposed at an opposite end of ITM belt 106 and provides suitable tension thereto.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into output media area 122 or enters duplex media path 124 for transport to second transfer area 114 for imaging on a second surface of the media sheet.

Imaging device 100 is depicted in FIG. 1 as a color laser printer in which toner is transferred to a media sheet in a two-step operation. Alternatively, imaging device 100 may be a color laser printer in which toner is transferred to a media sheet in a single-step process—from photoconductive members 110 directly to a media sheet. In another alternative embodiment, imaging device 100 may be a monochrome laser printer which utilizes only a single developer unit 104 and photoconductive member 110 for depositing black toner directly to media sheets. Further, imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling imaging device 100 to perform, among other functions, printing operations.

Still further, imaging device 100 includes a power supply 160. In the example embodiment, power supply 160 is a low voltage power supply which provides power to many of the components and modules of imaging device 100. Imaging device 100 may further include a high voltage power supply (not shown) for provide a high supply voltage to module and components requiring higher voltages.

Figure 2:
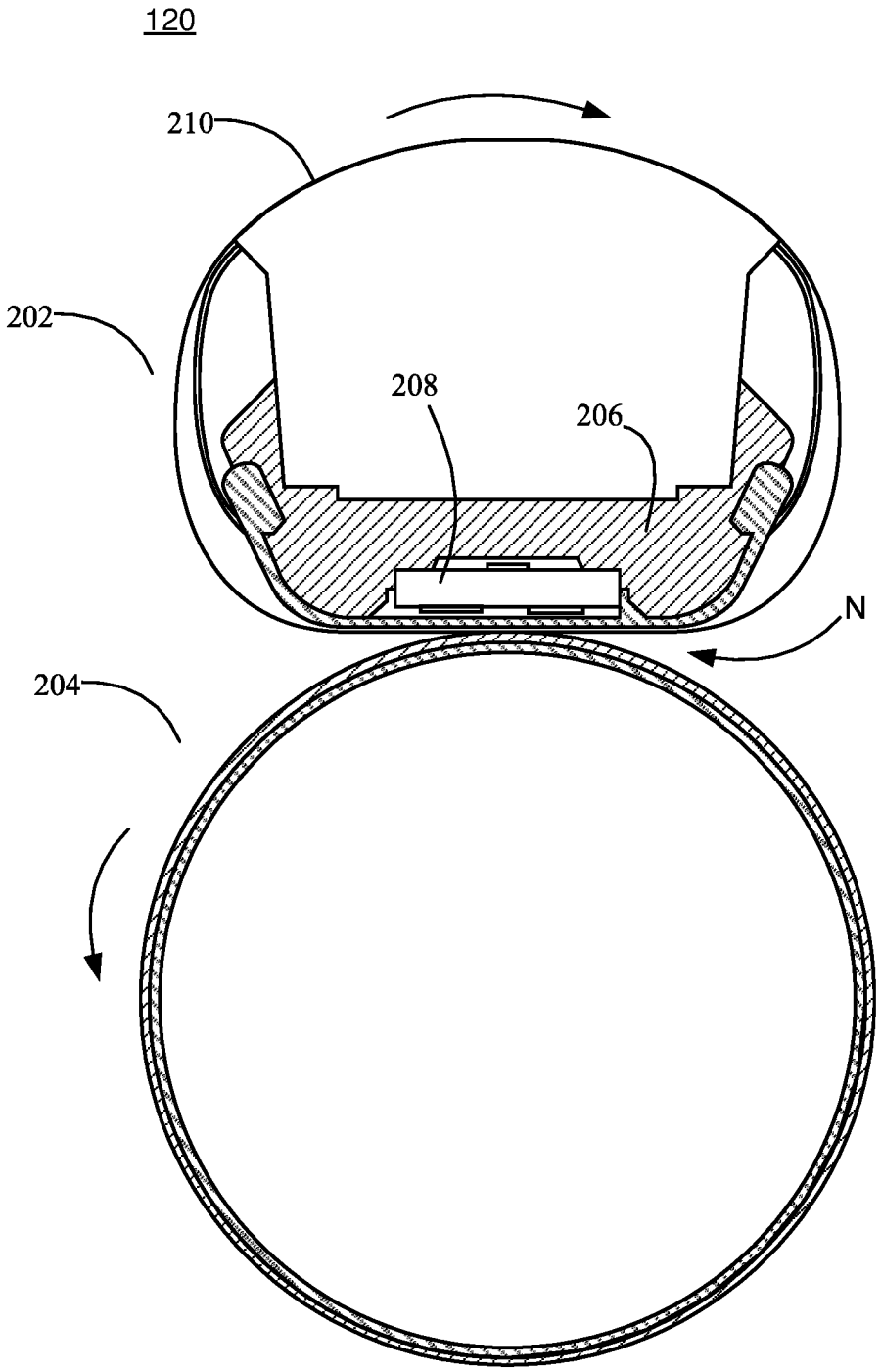
FIG. 2 is a side view of a fuser assembly of FIG. 1, according to an example embodiment.

With respect to FIG. 2, in accordance with an example embodiment, there is shown a fuser assembly 120 for use in fusing toner to sheets of media through application of heat and pressure. Fuser assembly 120 may include a heat transfer member 202 and a backup roll 204 cooperating with the heat transfer member 202 to define a fuser nip N for conveying media sheets therein. The heat transfer member 202 may include a housing 206, a heater member 208 supported on or at least partially in housing 206, and an endless flexible fuser belt 210 positioned about housing 206. Heater member 208 may be formed from a substrate of ceramic or like material to which at least one resistive trace is secured which generates heat when a current is passed through it. The inner surface of fuser belt 210 contacts the outer surface of heater member 208 so that heat generated by heater member 208 heats fuser belt 210. Heater member 208 may further include at least one temperature sensor, such as a thermistor, coupled to the substrate for detecting a temperature of heater member 208. It is understood that, alternatively, heater member 208 may be implemented using other heat-generating mechanisms.

Fuser belt 210 is disposed around housing 206 and heater member 208. Backup roll 204 contacts fuser belt 210 such that fuser belt 210 rotates about housing 206 and heater member 208 in response to backup roll 204 rotating. With fuser belt 210 rotating around housing 206 and heater member 208, the inner surface of fuser belt 210 contacts heater member 208 so as to heat fuser belt 210 to a temperature sufficient to perform a fusing operation to fuse toner to sheets of media.

Heat transfer member 202, fuser belt 210 and backup roll 204 may be constructed from the elements and in the manner as disclosed in U.S. Pat. No. 7,235,761, which is assigned to the assignee of the present application and the content of which is incorporated by reference herein in its entirety. It is understood, though, that fuser assembly 120 may have a different fuser belt architecture or even a different architecture from a fuser belt based architecture. For example, fuser assembly 120 may be a hot roll fuser, including a heated roll and a backup roll engaged therewith to form a fuser nip through which media sheets traverse. The hot roll fuser may include an internal or external heater member for heating the heated roll. The hot roll fuser may further include a backup belt assembly. Hot roll fusers, with internal and external heating forming the heat transfer member with the hot roll, and with or without backup belt assemblies, are known in the art and will not be discussed further for reasons of expediency.

Figure 3:
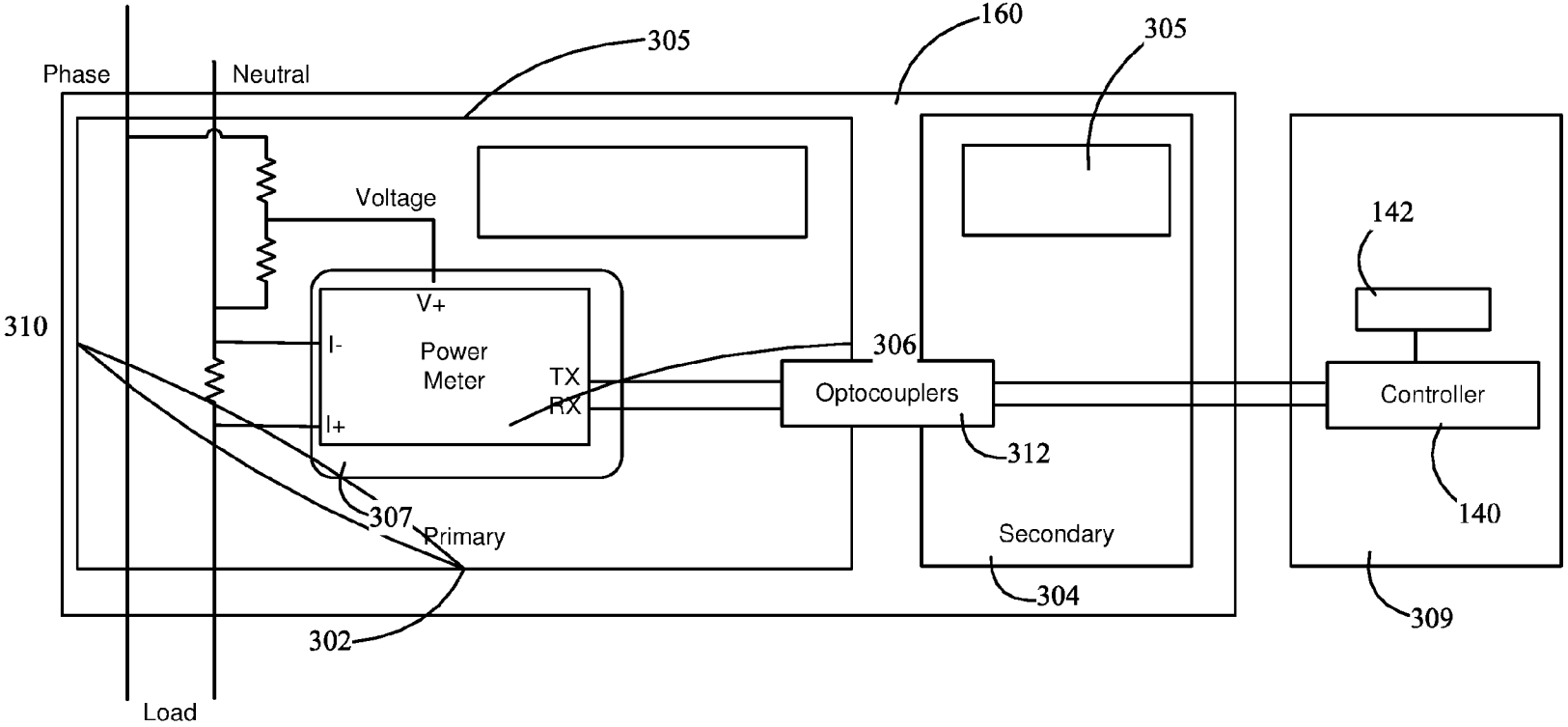
FIG. 3 is a simplified block diagram of a power supply of the imaging device of FIG. 1 according to an example embodiment.

FIG. 3 is a simplified representation of power supply 160. Power supply 160 includes circuitry on a primary side 302 and a secondary side 304 of the power supply. Primary side 302 and secondary side 304 include circuitry 305 found in conventional power supplies, including filter circuitry, rectifier circuitry, a transformer, power factor correction circuitry, etc., which will not be described for reasons of expediency. In addition to the conventional circuitry 305, primary side 302 includes a power meter circuit 306. In general terms, power meter circuit 306 measures current and voltage characteristics from a single phase line L1 in real time and provides such measurements and related data and statistics to controller 140. For example, power meter circuit 306 provides measurements of root mean square (RMS) voltage and RMS current, RMS (i.e., mean or average) power, power line frequency and zero cross detection. Power meter circuit 306 may be integrated into a single integrated circuit chip, and the integrated circuit chip may be located on a printed circuit board 307 in power supply 160. In the embodiment shown in FIG. 3, primary side 302 further includes shunt resistor 308 which is disposed along the neutral line NL and is coupled to power meter circuit 306 for use in measuring AC line current. In other example embodiments, a current transformer or a hall effect sensor, for example, may be used to measure AC line current instead of shunt resistor 308. Resistors 310 are connected between the phase line L1 and neutral line NL and are coupled to power meter circuit 306 for measuring AC line voltage. Optocouplers 312 provide isolation for communicating between power meter circuit 306 and controller 140, which is located on controller card 309 as shown in FIG. 3.

Figure 4:
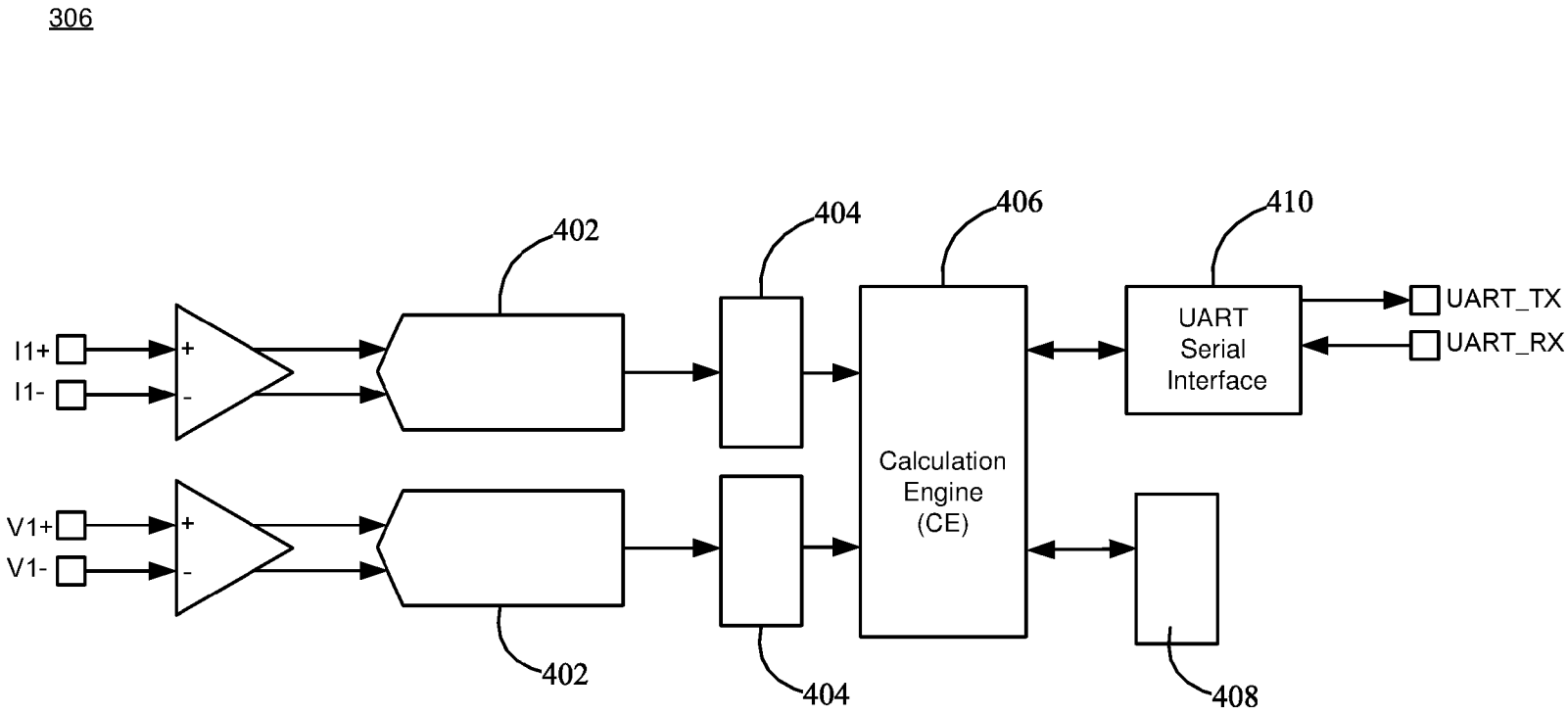
FIG. 4 is a simplified block diagram of a power meter device of the power supply of FIG. 3.

FIG. 4 shows an implementation of power meter circuit 306 according to an example embodiment. Power meter circuit 306 includes circuitry for receiving analog currents and voltages from a phase line L1 through coupling with resistors 308 and 310, respectively. For instance, power meter circuit 306 includes analog-to-digital converters (ADCs) 402 for receiving analog voltages corresponding to the measured AC line current and voltage and converting same to digital signals. Filters 404 may receive the digital outputs of ADCs 402 and provided filtered digital output signals. Power meter circuit 306 also includes processor 406 which is coupled to nonvolatile memory 408 and is configured to perform operations as specified by controller 140. Processor 406 may perform any of a number of operations, such as RMS calculations on sampled current and voltage values, instantaneous power, average power, power factor, and reactive power. Interface block 410 interfaces with controller 140 for communication between controller 140 and processor 406. In an example embodiment, controller 140 and processor 406 communicate over a serial interface, but it is understood that parallel communication may be employed. Power meter circuit 306 further includes a voltage rectifier (not shown) for providing a rectified DC supply voltage to ADCs 402, filters 404, processor 406, memory 408 and interface block 410.

Figure 5:
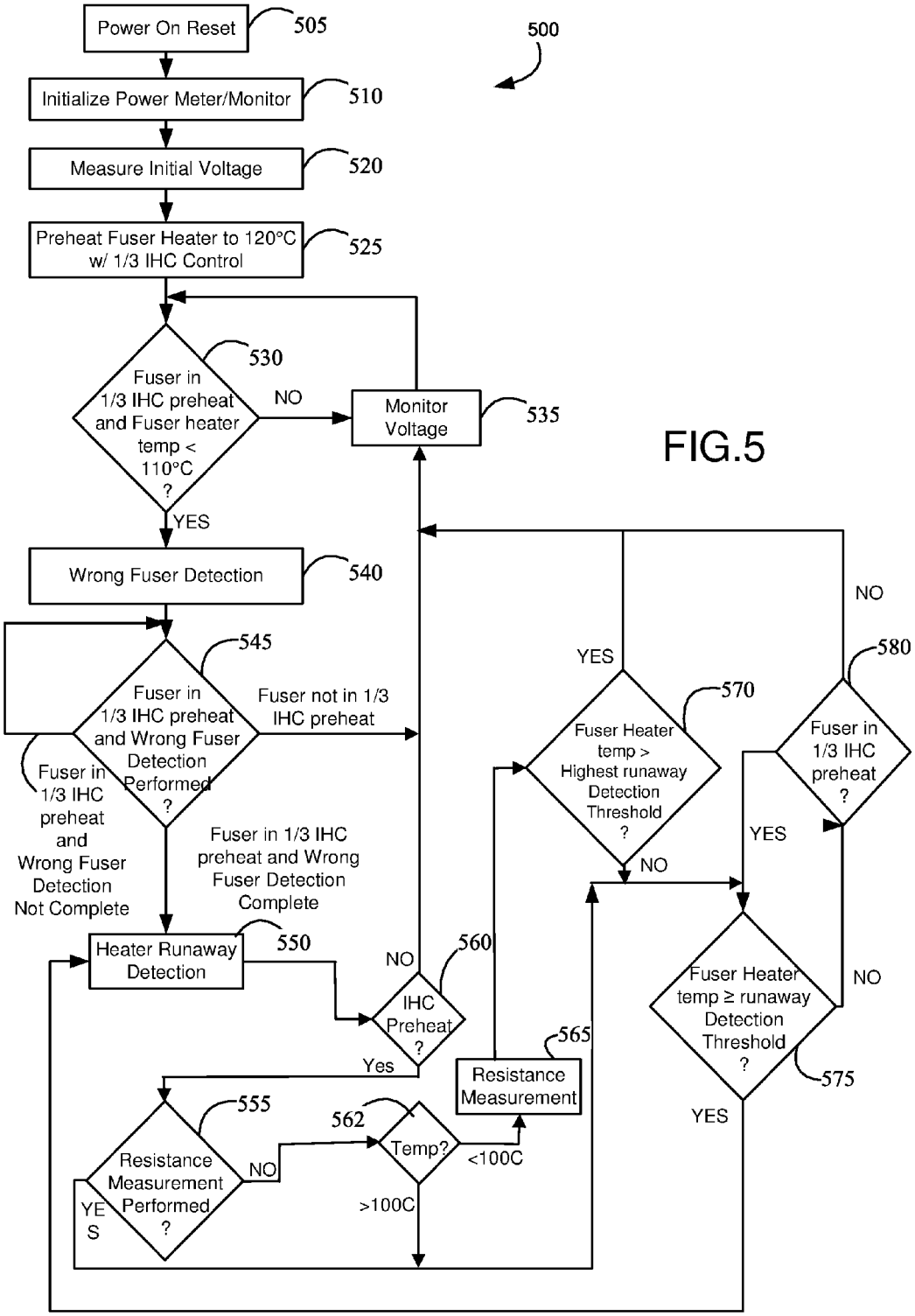
FIG. 5 is a flowchart of an example algorithm for preheating the fuser assembly of FIG. 1.

FIG. 5 shows an example preheat algorithm 500 performed by controller 140 for preheating heater member 208. In an example embodiment, preheat algorithm 500 is initialized when imaging device 100 is powered on or when imaging device 100 exits from a sleep mode of operation. At block 510, power meter circuit 306 is initialized. During initialization, communication is established between power meter circuit 306 and controller 140. At this point, power meter circuit 306 is also configured to report RMS voltage and the number of AC cycles per measurement period or computational cycle at every AC cycle.

At block 520, power meter circuit 306 measures initial line voltage of phase line L1. Controller 140 starts preheating heater member 208 at block 525, towards a first predetermined temperature, such as 120° C. The preheating of heater member 208 is accomplished under ⅓ integer half-cycle (IHC) control.

At block 530, controller 140 determines whether the temperature of heater member 208 is below a second predetermined temperature that is less than the first predetermined temperature, such as 110° C. Upon a negative determination, that is, if heater member 208 is too hot or is in a condition that requires user intervention, power meter circuit 306 is also configured to report RMS voltage and the number of AC cycles per measurement period or computational cycle at every 32 AC cycles, and the voltage is monitored at block 535 until heater member 208 is being preheated using ⅓ IHC and the temperature of heater member 208 is below 110° C.

If it is determined at block 530 that the temperature of heater member 208 is below 110° C., controller 140 runs a check for a wrong fuser in imaging device 100 at block 540. At block 540, controller 140 determines whether fuser assembly 120 for a low voltage (e.g., 110 v) imaging device 100 is placed in a high voltage (e.g., 220 v) imaging device 100, and vice versa. Checking for a wrong fuser serves to prevent not only poor printing quality but also damage to both fuser assembly 120 and imaging device 100. Wrong fuser detection may be accomplished via an algorithm such as wrong fuser detection algorithm 600, shown in FIG. 6.

Figure 6:
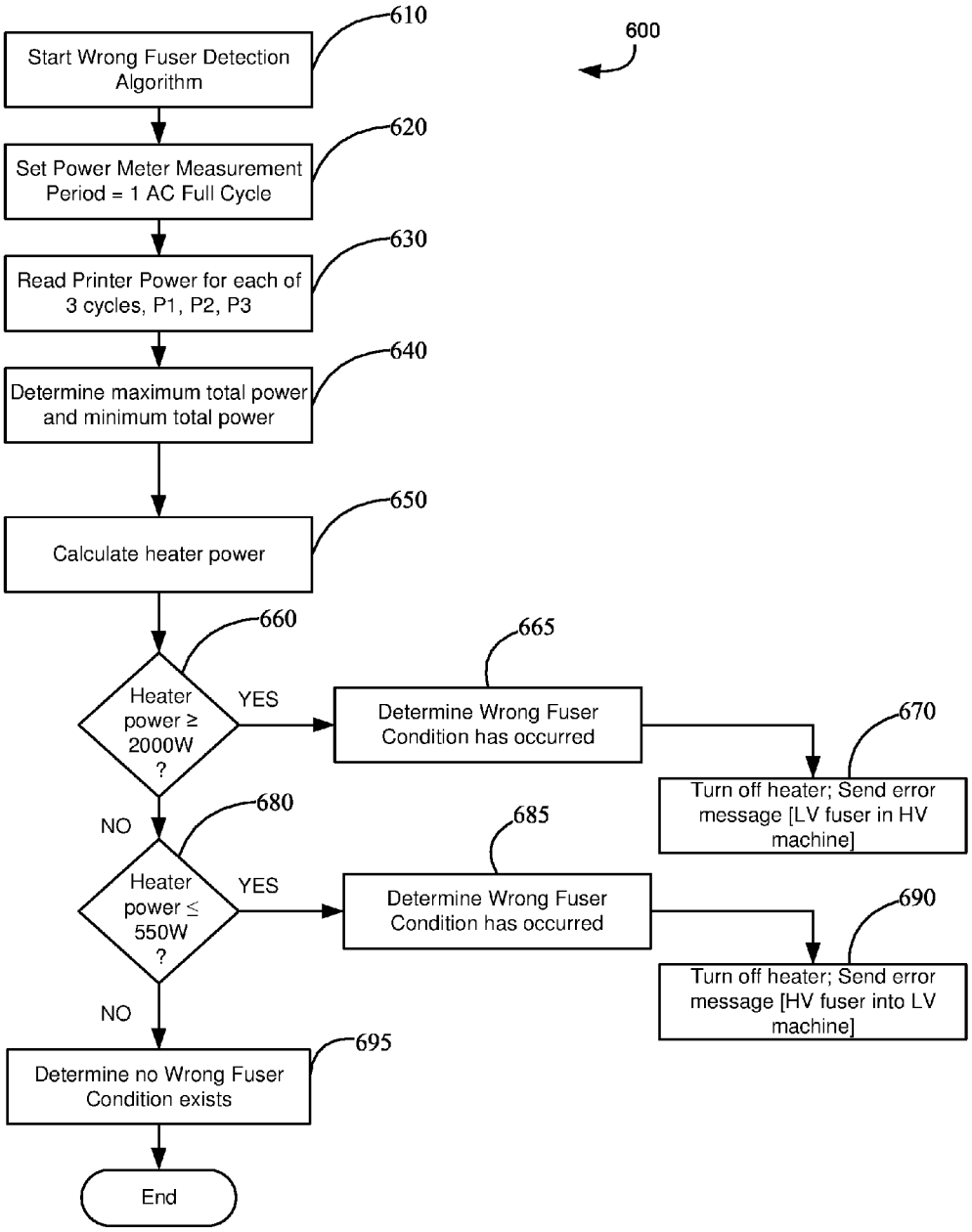
FIG. 6 is a flowchart of an example algorithm for detecting a wrong fuser during the preheating of the fuser assembly of FIG. 1.

FIG. 6 shows an example wrong fuser detection algorithm 600 for detecting the use of the wrong fuser in imaging device 100 during preheating of heater member 208. Example wrong fuser detection algorithm 600 is initiated at block 610 while the temperature of heater member 208 is below the second predetermined temperature. At block 620, the measurement period of power meter circuit 306 is set to one full AC cycle. At block 630, power meter circuit 306 calculates power supplied to imaging device 100 for each of three full AC cycles. The power calculation is based upon measuring the line voltage and current of phase line L1. The power calculations P1, P2, and P3, for each of the three AC cycles are then compared at block 640, and the maximum power, $P_{max}$, and minimum power, $P_{min}$, of imaging device 100 are identified based on the comparison.

At block 650, controller 140 determines heater power, $P_h$. Heater power, $P_h$, is the power supplied to heater member 208. Heater power $P_h$ is calculated using the maximum and minimum total power identifications, using the formula:

$$P_h=2*(P_{max}-P_{min})$$

At block 660, controller 140 determines whether the heater power $P_h$ calculated at block 650 is equal to or greater than a first predetermined heater power value. In an example embodiment, the predetermined heater power value is 2000 W. Upon a positive determination, controller 140 determines at block 665 that a wrong fuser condition has occurred in which fuser assembly 120 for a low voltage (e.g., 120 v) imaging device 100 is incorrectly used in a high voltage (e.g., 220 v) imaging device 100. Power to heater member 208 is switched off at block 670 and an error message is displayed on a display panel of imaging device 100 warning users of imaging device 100 of the wrong fuser condition.

However, upon a negative determination at block 660, the wrong fuser detection algorithm 600 proceeds to block 680. At block 680, if controller 140 determines at block 660 that the total heater power $P_h$ is not equal to greater than the predetermined heater power value (2000 W, in the example embodiment), controller 140 determines whether the heater power $P_h$ is equal to or less than a second predetermined heater power value. In the example embodiment, the second predetermined heater power value is 550 W. Upon a positive determination at block 680, controller 140 determines at block 685 that a wrong fuser condition has occurred in which fuser assembly 120 for a high voltage imaging device 100 is incorrectly used in a low voltage imaging device 100. Power to heater member 208 is switched off at block 690 and an error message is displayed on the display panel of imaging device 100 warning users of imaging device 100 of the wrong fuser condition. Upon a negative determination at block 680, controller 140 determines at block 695 that no wrong fuser condition exists. Wrong fuser detection algorithm 600 ends and preheat algorithm 500 of FIG. 5 continues.

Referring back to FIG. 5, at block 545 controller 140 determines whether the wrong fuser detection is complete and whether heater member 208 is still being preheated using ⅓ IHC. If it is determined that heater member 208 is no longer preheating (e.g., temperature is at or above 110° C., for example), power meter circuit 306 is also configured to report RMS line voltage and the number of AC cycles per measurement period or computational cycle at every 32 AC cycles, and the line voltage is monitored at block 535 until heater member 208 is being preheated using ⅓ IHC and the temperature of heater member 208 is below 110° C.

If it is determined at block 545 that heater member 208 is being preheated and wrong fuser detection is not complete, then control returns to block 545. If it is determined at block 545 that the wrong fuser detection is complete and the heater member 208 is being preheated, controller 140 checks for a heater runaway condition at block 550.

During operation, heater member 208 could "run away," that is, reach excessive temperatures, due to code bugs or a TRIAC in the fuser circuitry shorting. When this happens, heater member 208 has a much greater susceptibility to cracking. Typically, to prevent cracking, heater warm-up time during an excessive wattage check (EWC) is used to detect heater runaway. An EWC can check excessive heating, but cannot differentiate heater runaway from a wrong fuser being in imaging device 100. Also, an EWC may be only executed when the initial temperature of heater member 208 is below a predetermined temperature, such as 50° C. When a TRIAC is shorted when the time the initial temperature of heater member 208 is above 50° C., controller 140 and a programmable interface controller (PIC) circuit (not shown) may be unable to detect heater runaway. Using power meter circuit 306, however, controller 140 can timely detect a heater runaway condition during the time heater member 208 is being preheated, without any initial heater temperature restriction. In the example embodiment, the detection time of heater runaway is less than one hundred milliseconds, which is much shorter than a 2-3 second detection time using the EWC. The shorter runaway detection time allows for controller 140 to cut off power to heater member 208 much faster during heater runaway and greatly reduce heater crack risk as a result.

Figure 7:
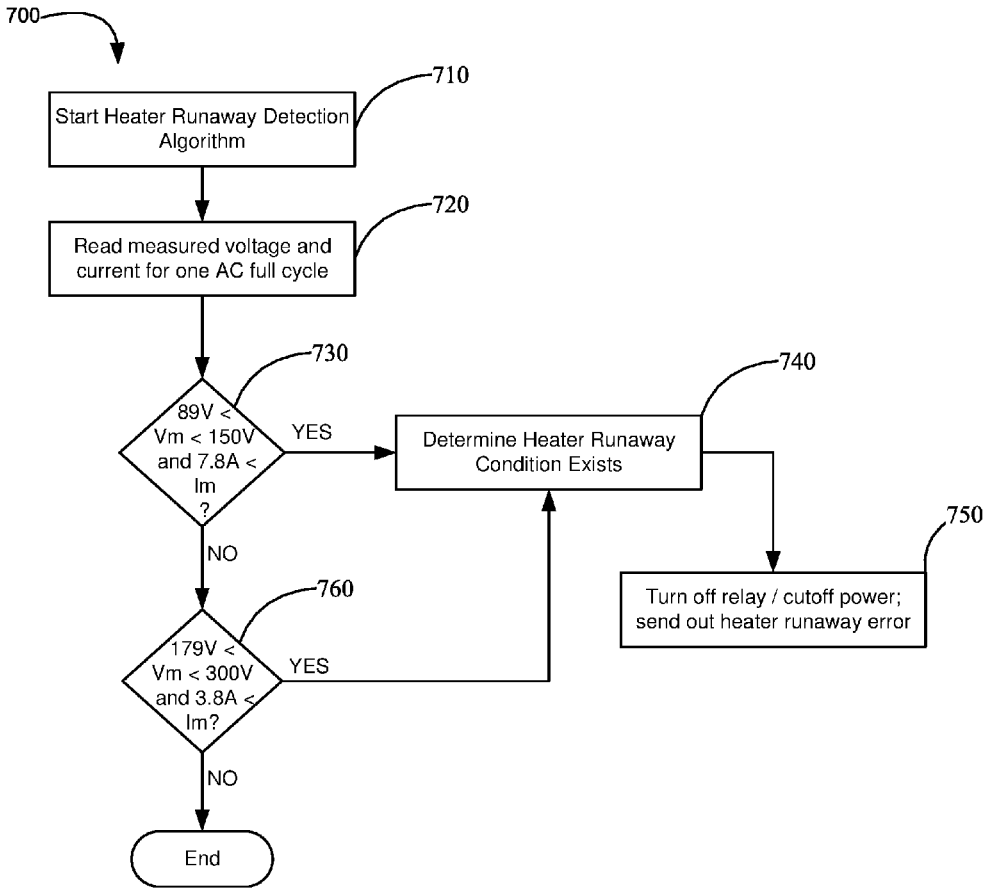
FIG. 7 is a flowchart of an example algorithm for detecting heater runaway during the preheating of the fuser assembly of FIG. 1.

At block 550, controller 140 checks for heater runaway using a heater runaway detection algorithm FIG. 7 shows an example heater runaway detection algorithm 700 for detecting heater runaway during preheating of heater member 208 that is performed at block 550.

Example heater runaway detection algorithm 700 is initiated at block 710 substantially immediately after completing a wrong fuser detection algorithm, such as wrong fuser detection algorithm 600, and may be repeated a number of times during the fuser heater preheating operation. For example, heater runaway detection algorithm 700 is executed when the temperature of heater member 208 reaches predetermined temperatures 50° C., 80° C., and 110° C. during the fuser heater preheating operation. At block 720, power meter circuit 306 measures the line voltage and current of phase line L1 supplied to imaging device 100 for one AC cycle, and reports the line voltage and current measurement to controller 140. At block 730, controller 140 determines whether the measured line voltage $V_m$ is higher than a first predetermined line voltage, such as 89V, and lower than a second predetermined line voltage, such as 150V. Controller 140 also determines at block 730 whether the measured line current $I_m$ value is greater than a predetermined line current value, such as 7.8 A. Upon a positive determination concerning both the measured line voltage and the measured line current, controller 140 determines at block 740 that a heater runaway condition exists. At block 750, controller 140 cuts off the power supply to heater member 208 and a heater runaway error message is displayed on the display panel of imaging device 100. Power supplied to heater member 208 may be cut off by controller 140 by opening the relay which supplies current to heater member 208. If controller 140 reaches a negative determination at block 730, controller 140 determines at block 760 whether the measured line voltage $V_m$ is higher than a third predetermined line voltage, such as 179V, and lower than a fourth predetermined line voltage, such as 300V. Controller 140 also determines at block 760 whether the measured line current $I_m$ value is greater than a second predetermined line current, such as 3.8 A. Upon controller 140 reaching a positive determination concerning both the measured line voltage and current at block 760, controller 140 determines that a heater runaway condition exists at block 740 and performs the acts of block 750 as described above. Upon a negative determination at block 760, heater runaway detection algorithm 700 ends and algorithm 500 of FIG. 5 continues.

As explained above, decision block 545 is performed during execution of wrong fuser detection algorithm 600 to check whether preheating of heater member 208 using ⅓ IHC ends before wrong fuser detection algorithm 600 has completed. In an example embodiment, a decision block like decision block 545 is performed during heater runaway detection algorithm 700 to determine whether preheating of heater member 208 using ⅓ IHC ends before heater runaway detection algorithm 700 is complete. In this way, if preheating ends during execution of heater runaway detection algorithm 700, process returns to block 535 where the line voltage is monitored until heater member 208 is being preheated using ⅓ IHC and the temperature of heater member 208 is below 110° C. Otherwise, heater runaway detection algorithm 700 runs to completion.

As mentioned above, heater runaway detection algorithm 700 is repeated when the temperature of heater member 208 reaches predetermined temperatures (50° C., 80° C., and 110° C., for instance). Once heater member 208 reaches a standby temperature of 120° C., heater runaway algorithm 700 is no longer used to detect heater runaway. Instead, from heater temperatures of 120° C. to 260° C., heater runaway may be monitored by directly measuring the temperature of heater member 208 using thermistors or the like associated with heater member 208. If heater member 208 reaches an allowed maximum heater temperature, such as 260° C., the PIC safety circuit of imaging device 100 will automatically cut off power supplied to heater member 208.

Referring again to FIG. 5, once heater runaway detection at block 550 is complete, controller 140 determines at block 560 whether heater member 208 is being preheated in ⅓ IHC. Upon a negative determination, preheat algorithm 500 proceeds to block 535 where the line voltage is monitored until heater member 208 is being preheated using ⅓ IHC and the temperature of heater member 208 is below 110° C.

Upon a positive determination at block 560, preheat algorithm proceeds to block 555 where controller 140 determines whether the algorithm for measuring the resistance of heater member 208 has been performed. If the resistance of heater member 208 has been measured, control proceeds to block 575. Upon a negative determination at block 555, preheat algorithm 500 proceeds to block 562 to determine whether the temperature of heater member 208 is above 100° C. If the temperature of heater member 208 is above 100° C., preheat algorithm 500 proceeds to block 575. If it is determined at block 562 that the temperature of heater member 208 is below 100° C., preheat algorithm 500 proceeds to block 565 to measure the resistance of heater member 208.

The resistance of heater member 208 varies with the temperature of heater member 208, with resistance increasing as the temperature increases and decreasing with a temperature drop. The difference in power required between a heater member 208 with the lowest resistance and heater member 208 with the highest resistance is about 120 W at nominal line voltage. To accurately calculate power of heater member 208 for a number of processes (such as speed control algorithm 3000 discussed below), it is beneficial for controller 140 to measure heater resistance of heater member 208. Instead of measuring the resistance at all possible fusing temperatures, the heater member 208 resistance is measured at a fixed temperature during preheating thereof. Resistance measurement at block 565 may be accomplished via an algorithm such as heater resistance algorithm 800, shown in FIG. 8.

Figure 8:
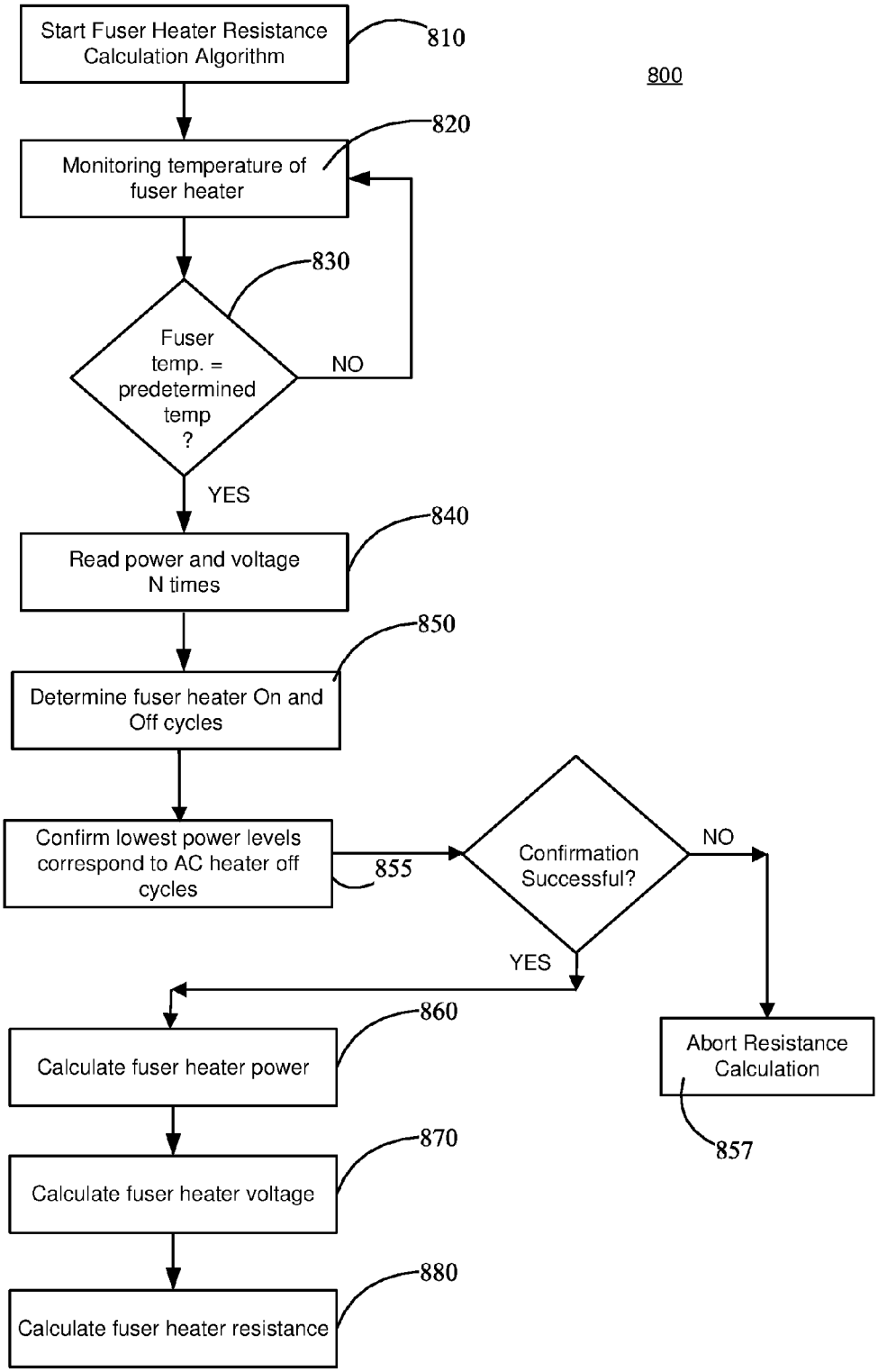
FIG. 8 is a flowchart of an example algorithm for measuring heater resistance during the preheating of the fuser assembly of FIG. 1.

FIG. 8 shows an example heater resistance calculation algorithm 800 for calculating a resistance of heater member 208. In general terms, heater resistance algorithm 800 calculates the resistance of heater member 208 based on the amount of power $P_h$ supplied to heater member 208. The power $P_h$ of heater member 208 is determined based on calculations of the power $P_N$ supplied to imaging device 100 during a predetermined number N of AC cycles and based on readings of the line voltage supplied to imaging device 100 during the N AC cycles, both of which are measured and/or determined by power meter circuit 306.

Heater resistance calculation algorithm 800 is initialized at block 810 during the fuser heater preheating operation for heating heater member 208 to a standby temperature. The measurement period for measuring power by power meter circuit 306 is set to one AC cycle. At block 820, if initial heater temperature is below a predetermined temperature, such as 50° C., the temperature of heater member 208 is monitored, and is periodically checked at block 830 to determine whether the temperature of heater member 208 has reached a second predetermined temperature, such as, for example, around 60° C.

Figure 13:
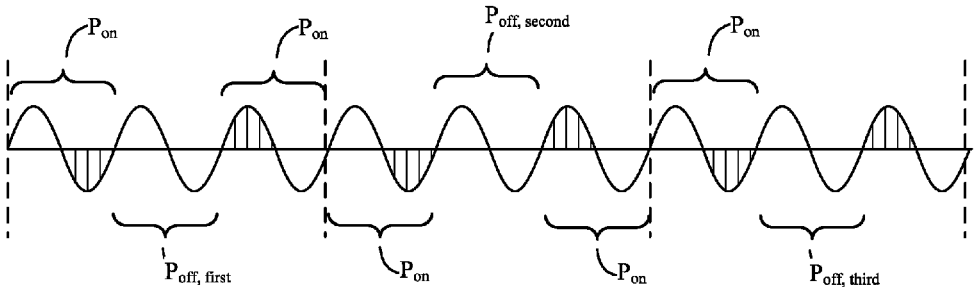
FIG. 13 illustrates the ⅓ integral half-cycle (IHC) control scheme implemented during the preheating of the fuser assembly of FIG. 1.

At block 840, once controller 140 has determined at block 830 that the temperature of heater member 208 has reached the second predetermined temperature, power $P_N$ of imaging device 100 and the line voltage for each of N consecutive AC cycles are measured and/or determined by power meter circuit 306. In some example embodiments, N is equal to nine and heater member 208 is powered using a ⅓ IHC control scheme. In the ⅓ IHC control scheme illustrated in FIG. 13, power is supplied to heater member 208 in six AC heater on cycles $P_{on}$ of the nine AC cycles, and power is not supplied to heater member 208 in three AC heater off cycles $P_{off}$ of the nine AC cycles.

At block 850, the AC heater on cycles $P_{on}$ are determined based on the determinations of power $P_N$ of imaging device 100 from block 840. To determine the AC heater on cycles $P_{on}$ in which heater member 208 is powered, the N power $P_N$ calculations of imaging device 100 are analyzed. An AC heater off cycle $P_{off}$, in which heater member 208 is not powered, is identified as any measured power level $P_N$ for an AC cycle that is less than a predetermined power level, such as 400 W.

At block 855, controller 140 confirms the lowest power levels of the nine AC cycles correspond to the three heater off cycles $P_{off}$ thereof. Specifically, controller 140 identifies as an AC heater off cycle $P_{off, first}$ the AC cycle from the first group of three of the nine AC cycles having the lowest power; the AC heater off cycle $P_{off, second}$ from the second group of three AC cycle having the lowest power; and the AC heater off cycle $P_{off, third}$ from the third group of three AC cycles having the lowest power. Controller 140 then confirms that the three identified AC heater off cycles $P_{off}$ are three AC cycles from each other, thereby corresponding to the ⅓ IHC control scheme. Upon a positive confirmation, action proceeds to block 860. Upon a negative confirmation, however, heater resistance calculation algorithm 800 is aborted at block 857.

Based on the determined AC heater off cycles $P_{off}$ in which power is not supplied to heater member 208, and upon certain assumptions, the heater power $P_h$ supplied to heater member 208 is determined at block 860. At block 860, if the magnitude of the power difference of the first and second AC heater off cycles $P_{off}$ of the N full AC power cycles is less than a predetermined fraction of the predetermined power level, such as 2.5%, it is assumed that there is no significant DC power change between the first AC heater off cycle $P_{off, first}$ and second AC heater off cycle $P_{off, second}$ and the heater power $P_h$ supplied to heater member 208 is calculated as $$P_h=2*(P_{on,second}-P_{off,second})$$

where $P_{on, second}$ is the average power of two AC heater on cycles $P_{on}$ that occur just before the second AC heater off cycle $P_{off, second}$ of the nine AC cycles. In addition, the heater voltage $V_{on}$ is calculated in block 870 as $$V_{on}=2*V_{on,second}-V_{off,second}$$

where $V_{on, second}$ is the measured line voltage to imaging device 100 during the AC heater on cycle $P_{on}$ that occurs immediately prior to AC heater off cycle $P_{off, second}$ and $V_{off, second}$ is the measured line voltage of the second AC heater off cycle $P_{off, second}$.

If the magnitude of the power difference of the 1st AC heater off cycle $P_{off, first}$ and 2nd AC heater off cycle $P_{off, second}$ is equal to or greater than the predetermined fraction (2.5%, for example) of the predetermined power level (400 W, for example), the power of the second AC heater off cycle $P_{off, second}$ is compared to the power of the third AC heater off cycle $P_{off, third}$ of the nine AC cycles. If the magnitude of the power difference between the power of the second AC heater off cycle $P_{off, second}$ and the power of the third AC heater off cycle $P_{off, third}$ is less than the predetermined fraction, it is assumed that there is no significant DC power change between the second AC heater off cycle $P_{off, second}$ and third heater off AC cycles $P_{off, third}$ and the heater power $P_h$ of heater member 208 is calculated in block 860 using the equation:

$$P_h=2*(P_{on,third}-P_{off,third})$$

where $P_{on, third}$ is the average power of two AC heater on cycles $P_{on}$ just before the third full AC heater off cycle $P_{off, third}$ of the nine AC cycles. In addition, the heater voltage $V_{on}$ is calculated in block 870 as $$V_{on}=2*V_{on,third}-V_{off,third}$$

where $V_{on,\ third}$ is the measured line voltage to imaging device 100 during the AC heater on cycle $P_{on,\ third}$ and $V_{off,\ third}$ is the line voltage to imaging device 100 during the third AC heater off cycle $P_{off,\ third}$ of the nine AC cycles.

If the magnitude of the power difference of the power in the first AC heater off cycle $P_{off,\ first}$ and second AC heater off cycle $P_{off,\ second}$ is greater than or equal to the predetermined fraction and the magnitude of the power difference in the second AC heater off cycle $P_{off,\ second}$ and third full AC heater off cycle $P_{off,\ third}$ is also greater than or equal to the predetermined fraction, the heater power $P_h$ is calculated in block 860 using the equation $$P_h=2*(P_{min\ heater\ On\ power}-P_{max\ heater\ Off\ power})$$

where $P_{min\ heater\ On\ power}$ is the minimum or lowest calculation of power during the AC heater on cycles $P_{on}$ and $P_{max\ heater\ Off\ power}$ is the maximum or highest calculation of power during the AC heater off cycles $P_{off}$. In addition, the heater voltage $V_{on}$ is calculated in block 870 as $$V_{on}=2*V_{min\ on}-V_{max\ off}$$

where $V_{min\ on}$ is the line voltage measurement during the AC heater on cycles $P_{on}$ that has minimum measured power, and $V_{max\ off}$ is the line voltage measurement during the AC heater off cycles $P_{off}$ having the maximum measured power.

In an alternative embodiment, if the magnitude of the power difference of the power in the first AC heater off cycle $P_{off,\ first}$ and second AC heater off cycle $P_{off,\ second}$ is greater than or equal to the predetermined fraction, and the magnitude of the power difference in the second AC heater off cycle $P_{off,\ second}$ and third full AC heater off cycle $P_{off,\ third}$ is also greater than or equal to the predetermined fraction, the heater resistance calculation is aborted and a previously calculated heater resistance is used since the power changes between the off cycles are too large.

At block 880, the resistance $R_m$ of heater member 208 is calculated using the calculations of heater power $P_h$ and heater on voltage $V_{on}$ from blocks 860 and 870, respectively. The heater resistance, $R_m$, is calculated as $$R_m=(V_{on})^2/P_h$$

The calculated heater resistance $R_m$ is then converted to the resistance at 60° C. using the formula:

$$R_{60\ degrees\ C.}=R_m+K*(60-T_m)$$

where $T_m$ is the temperature at which heater resistance $R_m$ was calculated and K is a slope constant. In some example embodiments, slope constant K is based on the voltage rating of heater member 208. If the voltage rating of heater member 208 is 100 volts, the slope constant K is set to a first predetermined value, such as 0.0031 Ohms/° C. If the voltage rating of heater member 208 is 115 volts, the slope constant K is set to a second predetermined value, such as 0.004 Ohms/° C. If the voltage rating of heater member 208 is 230 volts, the slope constant K is set to a third predetermined value, such as 0.011 Ohms/° C.

In other example embodiments, slope constant K is based on calculated heater resistance Rm. For example, if heater resistance Rm is less than a first predetermined resistance level, such as 9.5 Ohms, the slope constant K is set by controller 140 to a first predetermined value, such as 0.0031 Ohms/° C. If heater resistance Rm is greater than the first predetermined resistance level (9.5 Ohms) but less than a second predetermined resistance, such as 25 Ohms, the slope constant K is set by controller 140 to be a second predetermined value, such as 0.004 Ohms/° C. If heater resistance Rm is greater than the second predetermined resistance (25 Ohms), the slope constant K is set to a third predetermined value, such as 0.011 Ohms/° C.

Resistance $R_{60\ degrees\ C.}$ is stored in nonvolatile memory 408 for heater power calculations since heater resistance is not calculated when the temperature of heater member 208 is equal to or higher than 100° C.

As explained above, decision block 545 is performed during execution of wrong fuser detection algorithm 600 to check whether preheating of heater member 208 using ⅓ IHC ends before wrong fuser detection algorithm 600 has completed. In an example embodiment, a decision block like decision block 545 is performed during heater resistance algorithm 800 to determine whether preheating of heater member 208 using ⅓ IHC ended before heater resistance algorithm 800 is complete. In this way, if preheating ends during execution of heater resistance algorithm 800, process returns to block 535 where the line voltage is monitored until heater member 208 is being preheated using ⅓ IHC and the temperature of heater member 208 is below 110° C.

As mentioned above, heater runaway detection algorithm 700 is repeated at a number of predetermined instances during the fuser heater preheating operation (50° C., 80° C., and 110° C., in the example embodiment). Upon completion of heater resistance calculation algorithm 800 at block 565, controller 140 then determines at block 570 whether the temperature of heater member 208 is greater than the highest temperature threshold for heater runaway detection. Upon a positive determination at block 570, preheat algorithm 500 proceeds to block 535 where the line voltage is monitored until heater member 208 is being preheated using ⅓ IHC and the temperature of heater member 208 is below 110° C. Upon a negative determination at block 570, an affirmative determination at decision block 555, or a determination at decision block 562 that the temperature of heater member 208 is greater than 100° C., controller 140 determines at block 575 whether the temperature of heater member 208 is greater than or equal to the next predetermined temperature threshold for heater runaway detection. Upon a positive determination at block 575, preheat algorithm 500 returns to block 550 to rerun heater runaway detection.

Upon a negative determination at block 575, controller 140 checks at block 580 if heater member 208 is still being preheated using ⅓ IHC. If it is determined at block 580 that heater member 208 is still in ⅓ IHC preheat, preheat algorithm 500 returns to block 575 to check whether heater member 208 has reached or exceeded the next threshold for heater runaway detection. If it is determined at block 580 that heater member 208 is not in ⅓ IHC preheat, preheat algorithm 500 proceeds to block 535 where the line voltage is monitored until heater member 208 is being preheated using ⅓ IHC and the temperature of heater member 208 is below 110° C.

To reduce or minimize the time to first print (TTFP), i.e., the preparation time needed until imaging device 100 is ready to print the first sheet of media of a print job, imaging device 100 needs to accurately predict fuser ready time, i.e., the time for fuser assembly 120 to be ready to perform a fusing operation on the first sheet of media. The warm-up time of fuser assembly 120 directly depends on heating power of heater member 208 which, in turn, varies with line voltage and heater resistance $R_m$. To accurately predict fuser ready time, controller 140 calculates heater power $P_h$ before heater member 208 is warmed up. Based on the calculated heating power, controller 140 calculates the fuser ready time and from that calculation, and determines the timing for a number of components and modules of imaging device 100, such as the timing for locking the polygon mirror of LSU 130 and the timing for picking media sheets from the input tray of imaging device 100 so that media sheets arrive at fuser nip N just as fuser assembly 120 becomes ready to perform a fusing operation.

Figure 9:
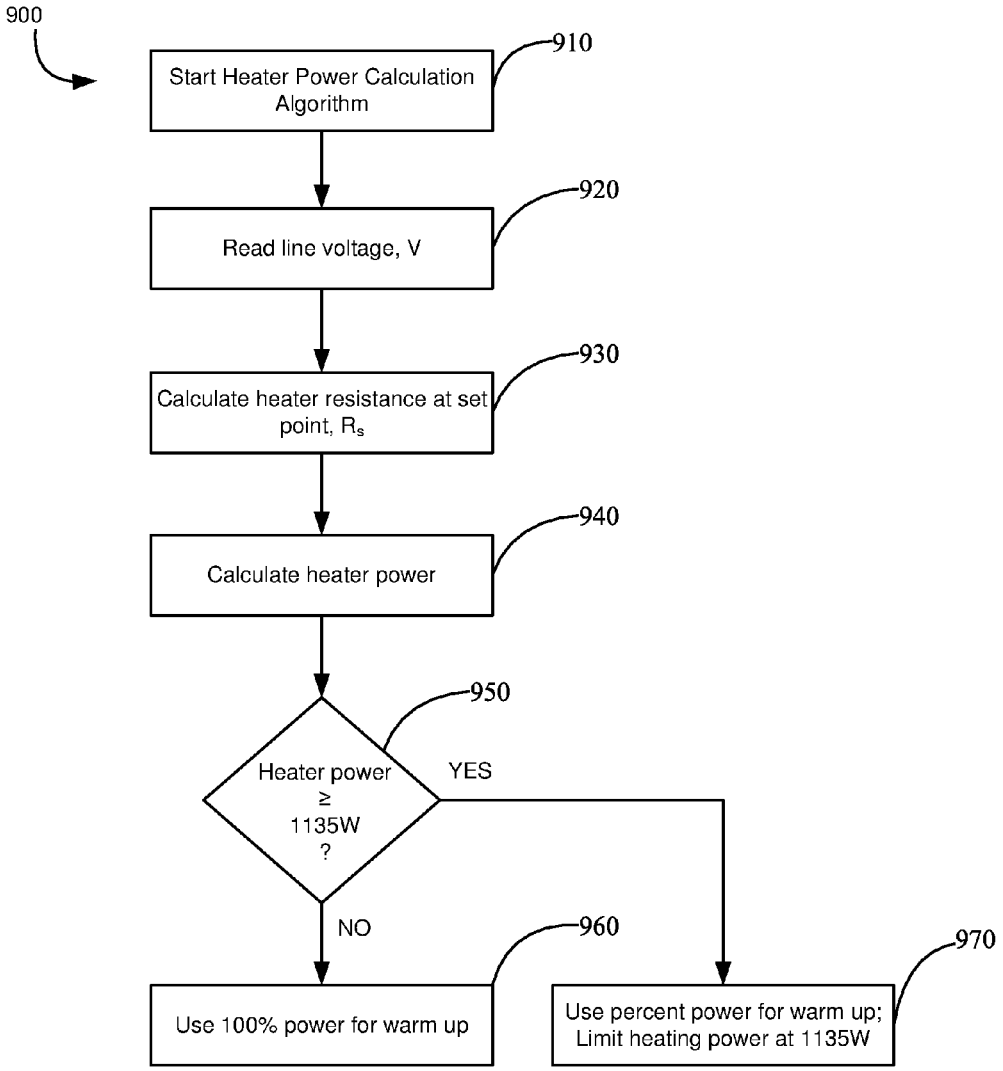
FIG. 9 is a flowchart of an example algorithm for calculating heater power during the preheating of the fuser assembly of FIG. 1.

FIG. 9 shows an example heater power calculation algorithm 900. Heater power calculation algorithm 900 is initiated at block 910 before heater member 208 is preheated to a standby temperature. At block 920, line voltage of phase line L1 is read by power meter circuit 306. At block 930, set point heater resistance $R_s$ is calculated. Set point heater resistance $R_s$ is the resistance of heater member 208 at a set point temperature, which is typically a fusing temperature, such as 220° C. Set point heater resistance is calculated using the equation:

$$R_s = R_{60\ degrees\ C.} + K(T_s - 60),$$

where $T_s$ is the set point temperature, and K is the slope constant.

At block 940, heater power $P_h$ is calculated using:

$$P_h = V^2/R_s$$

where V is the line voltage measured by power meter circuit 306, and $R_s$ is the set point heater resistance from block 930.

At block 950, controller 140 determines whether the maximum heater power $P_h$ of heater member 208 is greater than or equal to a second predetermined power level, such as 1135 W. If the maximum heater power $P_h$ is less than 1135 W, all of the power is used for heating heater member 208 in a warm-up operation at block 960.

To achieve more consistent TTFP for a line voltage equal to 110V or higher for all heater members 208, and to prevent excessive heating at high line voltages, heating power during warm-up is limited, for example, at the second predetermined power level (1135 W). If controller 140 determines that the maximum heater power $P_h$ is equal to or greater than the second predetermined power level, the heating power $P_h$ during heater warm-up is limited to the second predetermined power level. At block 970, only a percentage of the maximum heating power $P_h$ is thus used. The percentage of the maximum heating power used for warm up is calculated as:

$$\text{Percent Power} = (1135W/P_h)*100$$

where $P_h$ is the calculated maximum heater power at the current line voltage, calculated at step block 940. Based on the calculated percent power, controller 140 determines the phase control time delay to limit the heating power at 1135 W during operations to warm up heater member 208.

Figure 10:
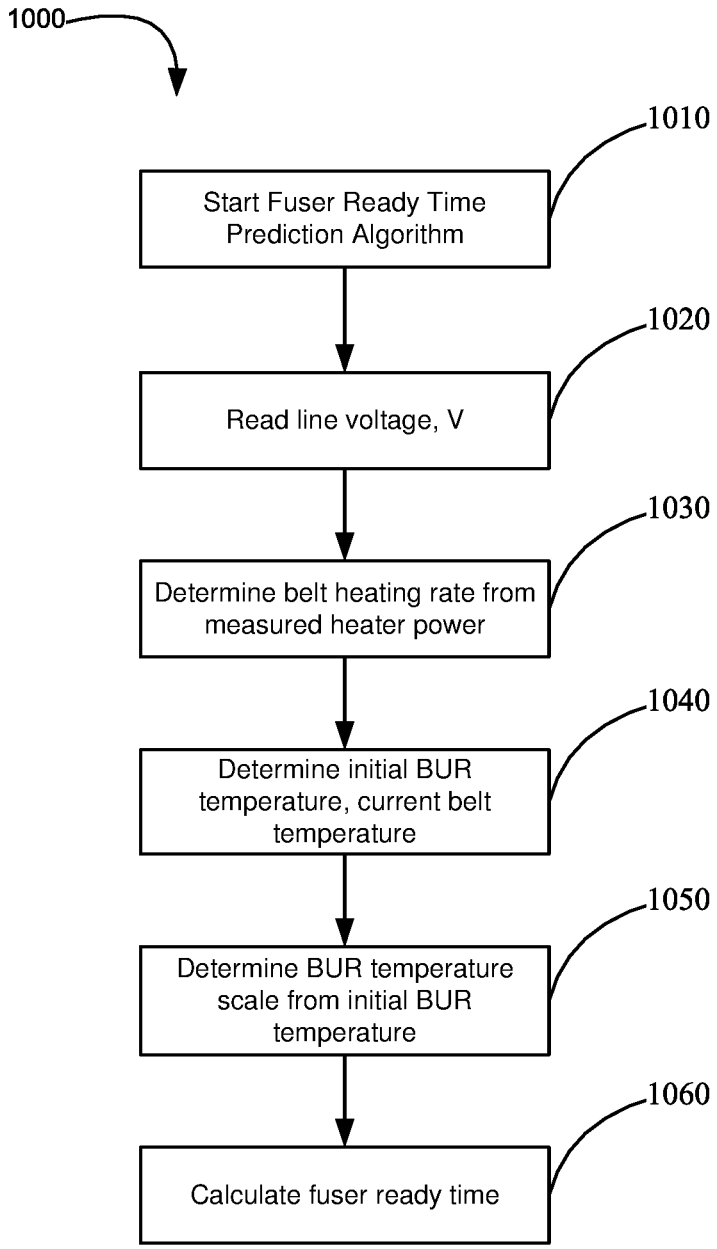
FIG. 10 is a flowchart of an example algorithm for predicting fuser ready time during the preheating of the fuser assembly of FIG. 1.

FIG. 10 shows an example fuser ready time prediction algorithm 1000 for predicting the amount of time before fuser assembly 208 of imaging device 100 is ready to perform a fusing operation. As mentioned, more accurately predicting fuser ready time is beneficial for ensuring that the modules of imaging device 100 operate at the appropriate time relative to each other. Fuser ready time prediction algorithm 1000 is initialized at block 1010 after heater power has been determined by heating power calculation algorithm 900, for example.

At block 1020, the line voltage of phase line L1 provided to imaging device 100 is read by power meter circuit 306. At block 1030, belt heating rate is determined from the heater power calculated by heating power calculation algorithm 900. Belt heating rate, which is the rate associated with heating fuser belt 210, is determined by controller 140 using linear interpolation based on the calculated heater power from block 950 of heater power calculation algorithm 900 and a heating rate table stored in memory 142. At block 1040, the initial temperature of backup roll 116 and current temperature of fuser belt 210 are determined. The initial temperature of backup roll 116 and current temperature of fuser belt 210 may be determined through the use of temperature sensors as is known in the art.

At block 1050, a backup roll (BUR) temperature scale is determined. The BUR temperature scale is determined using linear interpolation based on the initial temperature of BUR 116 and a BUR temperature scale table stored in memory 142. At block 1060, fuser ready time is calculated using the formula, $$\text{Fuser Ready Time} = \text{BUR temperature scale}*(\text{Belt Set Point Temperature} - \text{Current Belt Temperature})/\text{Belt Heating Rate}$$

In an example embodiment, fuser ready time is calculated several times during warm-up.

Figure 11:
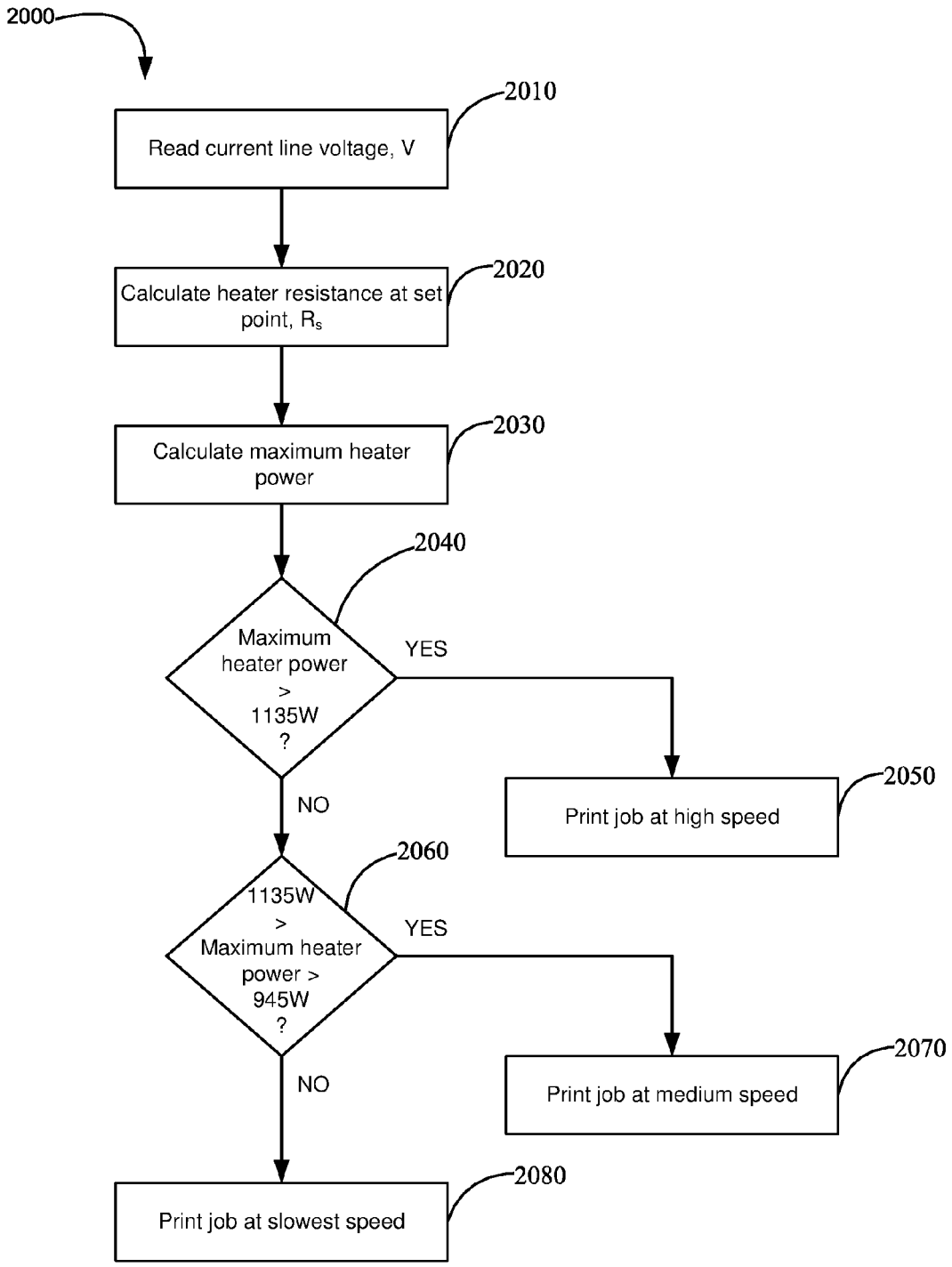
FIG. 11 is a flowchart of an example algorithm for printer speed control before printing, based on available heater power.
Figure 12:
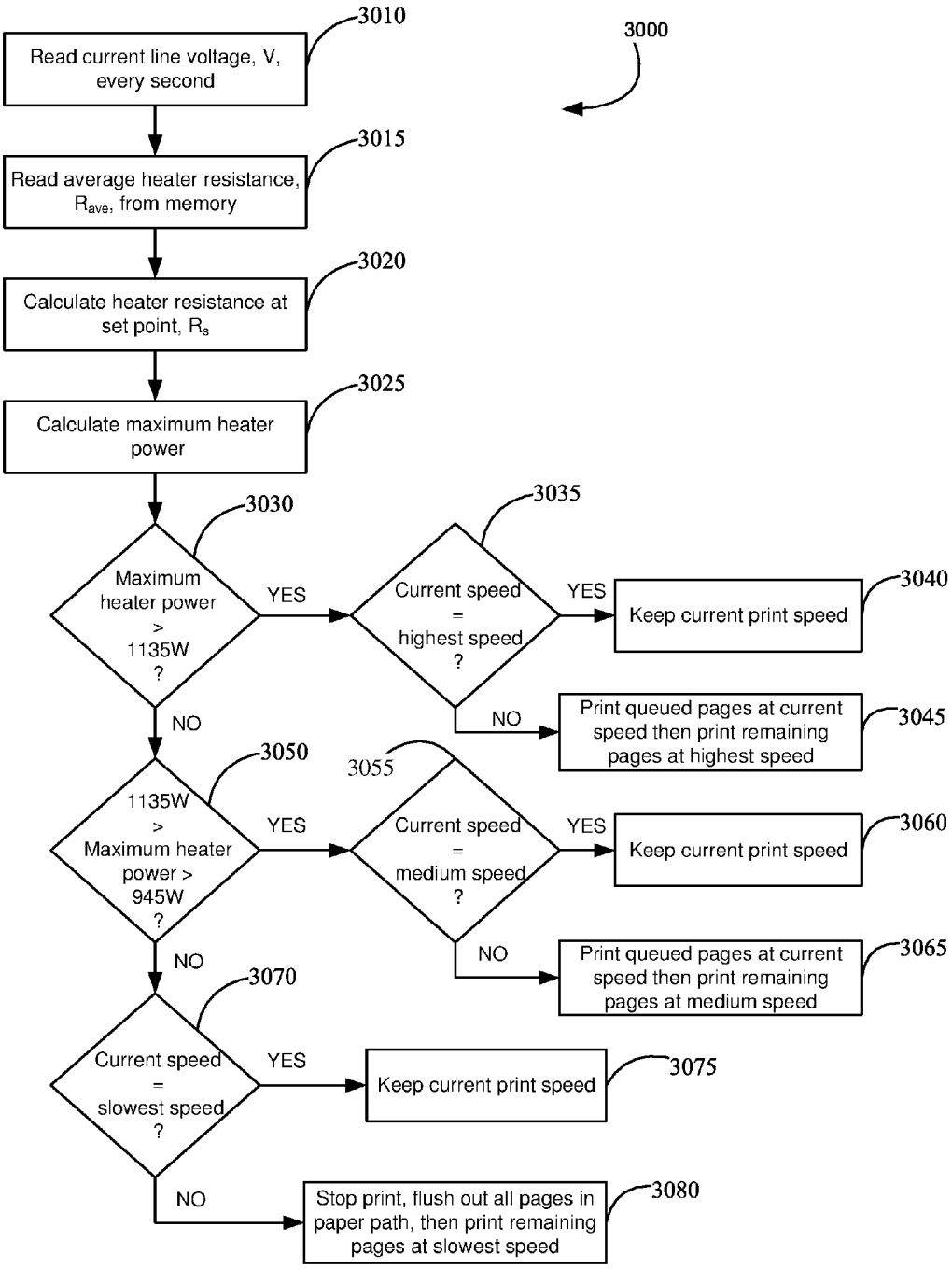
FIG. 12 is a flowchart of an example algorithm for printer speed control during printing, based on available heater power.

Using power meter circuit 306, controller 140 can not only more accurately calculate fuser ready time but also properly determine the operating speed point for fusing/printing in order to avoid poor fusing quality. At low line voltages, heater member 208 may not have enough power to maintain the fusing temperature around the desired temperature set point for the highest speed, thus causing poor toner fusing or cold offset. By accurately determining heater power at the current line voltage, controller 140 can adjust print speed based on the available heating power so as to avoid poor toner fusing quality or a low fuser temperature error. FIGS. 11 and 12 show example algorithms for print speed control based on available heater power.

FIG. 11 shows an example algorithm 2000 for setting the print speed of imaging device 100 prior to printing. When a print job is ready to be printed, the line voltage of phase line L1 is read from power meter circuit 306 at block 2010. At block 2020, set point heater resistance $R_s$ is calculated for the target fusing temperature Ts. At block 2030, the maximum heater power $P_h$ is calculated. The calculation of blocks 2010 to 2030 may perform actions taken in blocks 920 to 950 of heater power calculation algorithm 900 described above.

At block 2040, controller 140 determines whether the maximum heater power $P_h$ of heater member 208 is higher than the second predetermined power level, which is 1135 W, for example. If the maximum heater power $P_h$ is higher than 1135 W, the print job is printed at the rated or high speed for imaging device 100, for example 60 pages per minute (ppm), at block 2050. If the maximum heater power $P_h$ is lower than 1135 W, another determination is made at block 2060.

At block 2060, controller 140 determines whether the maximum heater power $P_h$ is between the second predetermined power level (1135 W) and a third predetermined power level, such as 945 W. Upon an affirmative determination at block 2060, the print job is printed at a medium speed for imaging device 100, for example 50 ppm, at block 2070. If the maximum heater power $P_h$ is lower than the third predetermined power level, the print job is printed at a slow speed for imaging device 100, for example 30 ppm, at block 2080.

Algorithm 2000 is used to set the print speed prior to performing a printing operation. Since AC line voltage could change at any time, it is desired that controller 140 can automatically adjust print speed during a print operation based on line voltage conditions in order to improve throughput and better avoid insufficient fusing. With power meter circuit 306, controller 140 can slow print speeds when the line voltage measured during a printing operation is low and return imaging device 100 to high speed printing when the line voltage recovers to normal line voltage levels during the printing operation.

FIG. 12 shows an example algorithm 3000 for controlling the print speed of imaging device 100 during printing. During printing, the line voltage of phase line L1 is read every second by power meter 306 at block 3010. At block 3015, average heater resistance is read from nonvolatile memory 408 or is already placed in RAM.

At block 3020, controller 140 calculates the set point heater resistance and at block 3025, maximum heater power $P_h$ is calculated. The calculations of blocks 3020 and 3025 may perform the actions taken in blocks 920 to 950 of heater power calculation algorithm 900 described above.

At block 3030, controller 140 determines whether the maximum heater power $P_h$ is higher than the second predetermined power level, which is 1135 W in an example embodiment. If controller 140 determines at block 3030 that the maximum power is lower than 1135 W, another determination is made at block 3050. If the maximum heater power $P_h$ is higher than 1135 W, controller 140 determines at block 3035 whether the current print speed corresponds to the rated or high speed, for example, 60 ppm. If the current speed is determined to be the high speed, controller 140 makes no change to the print speed and the printing continues at high speed at block 3040. If controller 140 determines at block 3035 that the current print speed is slower than the high speed, all pages already queued are printed at the current speed at block 3045, and then the remaining pages in the print job are printed at the high speed.

At block 3050, controller 140 determines whether the maximum heater power $P_h$ is between the second predetermined power level (1135 W) and the third predetermined power level (945 W in the example embodiment). If the maximum heater power $P_h$ is lower than the second predetermined power level and higher than the third predetermined power lever, controller 140 determines at block 3055 whether the current print speed corresponds to a medium speed, for example, 50 ppm. If the current speed is the medium speed, controller 140 makes no change to the print speed and the printing continues at block 3060. If controller 140 determines at block 3055 that current print speed is not equal to the medium speed, all pages already queued are printed at the current speed at block 3065, and then the remaining pages are printed at the medium speed.

If controller 140 determines at block 3050 that the maximum heater power $P_h$ is lower than the third predetermined power level, controller 140 determines at block 3070 whether the current speed corresponds to a slow speed, for example, 30 ppm. If the current speed is determined to be the slow speed, controller 140 makes no change to the print speed and the printing continues at block 3075. If current speed is higher than the slowest speed, printing is stopped by controller 140 at block 3080, and all pages already in the paper path are flushed from imaging device 100 and then the remaining pages are printed at the slow speed.

It is understood that some print jobs cannot be executed at high speed due to the type of media and/or the required resolution, and therefore controller 140 will not elect to speed up the fusing operation beyond the speed for the type of media. The description of the details of the example embodiments have been described in the context of a color electrophotographic imaging devices. However, it will be appreciated that the teachings and concepts provided herein are applicable to multifunction products employing color electrophotographic imaging.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for controlling a fuser heater of a fuser assembly for an electrophotographic device, the method comprising:

initiating a preheat operation for preheating the fuser heater;

when the fuser heater temperature reaches a predetermined temperature during the preheat operation, reading, by the electrophotographic device, current and voltage of the electrophotographic device for a plurality of consecutive AC cycles;

from the current and voltage readings, determining, by the electrophotographic device from the plurality of consecutive AC cycles, heater on cycles in which power is applied to the fuser heater and heater off cycles in which power is not applied to the fuser heater;

calculating, by the electrophotographic device, heater power from the current and voltage readings and the determinations of the heater on cycles and the heater off cycles, the heater power being the power of the fuser heater during a predetermined heater on cycle of the consecutive AC cycles;

calculating, by the electrophotographic device, a fuser heater voltage of the fuser heater during the predetermined heater on cycle based on the voltage readings;

calculating, by the electrophotographic device, a resistance of the fuser heater based on the calculated heater power and the calculated fuser heater voltage; and controlling the fuser assembly based upon the calculated resistance of the fuser heater, wherein calculating heater power comprises comparing a power level of the imaging device in a first heater off cycle of the consecutive AC cycles to a power level of the imaging device in a second heater off cycle of the consecutive AC cycles, wherein the heater power calculation is based upon the comparison.

2. The method of claim 1, wherein the comparing comprises calculating an absolute difference between the power level of the imaging device in the first heater off cycle of the consecutive AC cycles and the power level of the imaging device in the second heater off cycle of the consecutive AC cycles, and selecting a formula for calculating the heater power from a plurality of formulas for calculating heater power, based upon the absolute difference.

3. The method of claim 2, wherein if the absolute difference is less than a predetermined power threshold, the formula for calculating heater power that is selected calculates heater power based upon a first factor multiplied by a difference between a calculated power level of the imaging device in at least one first heater on cycle immediately prior to the second heater off cycle and the power level of the imaging device in the second heater off cycle.

4. The method of claim 3, wherein if the absolute power difference is less than the predetermined power threshold, calculating the fuser heater voltage comprises multiplying a second factor by the voltage reading of the imaging device in the first heater on cycle and subtracting therefrom the voltage reading of the imaging device in the second heater off cycle.

5. The method of claim 3, wherein if the absolute difference is greater than the predetermined power threshold, calculating heater power comprises comparing the power level of the imaging device in the second heater off cycle to a power level of the imaging device in a third heater off cycle of the consecutive AC cycles, wherein the calculated heater power is based upon the comparison.

6. The method of claim 5, wherein comparing the power level of the imaging device in the second heater off cycle to the power level of the imaging device in the third heater off cycle comprises calculating an absolute difference between the power level of the imaging device in the second heater off cycle and the power level of the imaging device in the third heater off cycle and comparing the absolute difference to the predetermined power threshold.

7. The method of claim 6, wherein if the absolute difference between the power level of the imaging device in the second heater off cycle and the power level of the imaging device in the third heater off cycle is less than the predetermined power threshold, the formula for calculating heater power that is selected calculates heater power of the fuser heater based upon the first factor multiplied by a difference between a calculated power level of the imaging device in at least one second heater on cycle immediately prior to the third heater off cycle and the power level of the imaging device in the third heater off cycle.

8. The method of claim 7, wherein if the absolute difference between the power level of the imaging device in the second heater off cycle and the power level of the imaging device in the third heater off cycle is less than the predetermined power threshold, the fuser heater voltage is calculated based upon the voltage reading of the imaging device in the second heater on cycle and the voltage reading of the imaging device in the third heater off cycle.

9. The method of claim 6, wherein if the absolute difference between the power level of the imaging device in the second heater off cycle and the power level of the imaging device in the third heater off cycle is greater than the predetermined power threshold, the formula for calculating heater power that is selected calculates heater power of the fuser heater based upon the first factor multiplied by a difference between a minimum power level of the imaging device in a heater on cycle of the consecutive AC cycles and a maximum power level of the imaging device in a heater off cycle of the consecutive AC cycles.

10. The method of claim 6, wherein if the absolute difference between the power level of the imaging device in the second heater off cycle and the power level of the imaging device in the third heater off cycle is greater than the predetermined power threshold, the fuser heater voltage is calculated based upon the second factor multiplied by the minimum voltage level of the imaging device in a heater on cycle of the consecutive AC cycles, less the maximum voltage level of the imaging device in a heater off cycle of the consecutive AC cycles.

11. The method of claim 1, further comprising identifying a first heater off cycle of the consecutive AC cycles and calculating heater power based upon a first factor multiplied by a difference between a calculated power level of the imaging device in at least one first heater on cycle immediately prior to the first heater off cycle and the power level of the imaging device in the first heater off cycle.

12. An imaging device, comprising:

a photoconductive member;

a developer unit for developing a toner image on the photoconductive member;

at least one toner transfer area for transferring the toner image to a sheet of media as the sheet of media passes through the toner transfer area in a media feed direction;

a fuser assembly positioned downstream of the at least one toner transfer area in the media feed direction for fusing toner transferred to the sheet of media, the fuser assembly including a fuser heater member;

a power supply circuit coupled to the fuser assembly for supply power thereto; and a controller coupled to the power supply circuit and the fuser assembly for controlling heat generated by the fuser heater member, and memory coupled to the controller, the controller configured to execute instructions stored in the memory for:

when a temperature of the fuser heater member reaches a predetermined temperature during a preheat operation, receiving current and voltage readings of the imaging device for a plurality of consecutive AC cycles;

from the current and voltage readings, determining, from the plurality of consecutive AC cycles, heater on cycles in which power is applied to the fuser heater member and heater off cycles in which power is not applied to the fuser heater member;

calculating heater power from the current and voltage readings and the determinations of the heater on cycles and the heater off cycles, the heater power being the power of the fuser heater member during a predetermined heater on cycle of the consecutive AC cycles;

calculating a fuser heater voltage of the fuser heater member during the predetermined heater on cycle based on the calculated voltage readings;

calculating a resistance of the fuser heater member based on the calculated heater power and the calculated fuser heater voltage; and controlling the fuser assembly based upon the calculated resistance of the fuser heater member, wherein calculating heater power comprises comparing a power level of the imaging device in a first heater off cycle of the consecutive AC cycles to a power level of the imaging device in a second heater off cycle of the consecutive AC cycles, and selecting a formula for calculating the heater power from a plurality of formulas for calculating heater power based upon the comparison.

13. The imaging device of claim 12, wherein if the controller determines that a difference between the power level in the first heater off cycle and the power level in the second heater off cycle is less than a predetermined power threshold, the formula for calculating heater power that is selected by the controller calculates heater power based upon a first factor multiplied by a difference between a calculated power level of the imaging device in at least one first heater on cycle immediately prior to the second heater off cycle and the power level of the imaging device in the second heater off cycle.

14. The imaging device of claim 13, wherein if the controller determines that a difference between the power level in the first heater off cycle and the power level in the second heater off cycle is less than a predetermined power threshold, the controller calculates the fuser heater voltage based upon the voltage reading of the imaging device in the first heater on cycle and the voltage reading of the imaging device in the second heater off cycle.

15. The imaging device of claim 13, wherein if controller determines that the difference between the power level of the imaging device in the first heater off cycle and the power level of the imaging device in the second heater off cycle is greater than the predetermined power threshold, the controller compares the power level of the imaging device in the second heater off cycle to a power level of the imaging device in a third heater off cycle of the consecutive AC cycles, and selects a formula for calculating the heater power from the plurality of formulas for calculating heater power based upon the comparison.

16. The imaging device of claim 15, wherein if the controller determines that a difference between the power level in the second heater off cycle and the power level in the third heater off cycle is less than the predetermined power threshold, the formula for calculating heater power that is selected by the controller calculates heater power based upon the first factor multiplied by a difference between a calculated power level of the imaging device in at least one second heater on cycle immediately prior to the third heater off cycle and the power level of the imaging device in the third heater off cycle, and the controller calculates heater voltage based upon a voltage of the imaging device in the second heater on cycle and the voltage of the imaging device in the third heater off cycle.

17. The imaging device of claim 15, wherein if the controller determines that a difference between the power level in the second heater off cycle and the power level in the third heater off cycle is greater than the predetermined power threshold, the formula for calculating heater power that is selected by the controller calculates heater power based on a minimum power level of the heater on cycles of the consecutive AC cycles and a maximum power level of the heater off cycles of the consecutive AC cycles.

18. The imaging device of claim 17, wherein if the controller determines that a difference between the power level in the second heater off cycle and the power level in the third heater off cycle is greater than the predetermined power threshold, the controller calculates fuser heater voltage based upon a minimum voltage level of the imaging device in a heater on cycle of the consecutive AC power levels and a maximum voltage of the imaging device in the heater off cycles of the consecutive AC power levels.

19. The imaging device of claim 12, wherein the controller identifies a first heater off cycle of the consecutive AC cycles and calculates heater power based upon a first factor multiplied by a difference between a power level of the imaging device in a first heater on cycle immediately prior to the first heater off cycle and the power level of the imaging device in the first heater off cycle.

20. The imaging device of claim 19, wherein the controller calculates the fuser heater voltage based upon the voltage reading of the imaging device in the first heater on cycle and the voltage reading of the imaging device in the first heater off cycle.

* * * * *